284816 0807 --00 03-19-91 27710 02-13-91 222211 78147.0 05000633 2565

United States Patent [19]

Kowalik et al.

[11] Patent Number: 5,000,633

[45] Date of Patent: Mar. 19, 1991

[54] RAILWAY FREIGHT CAR SHOE DESIGN

[75] Inventors: John J. Kowalik, Glenview; David C. Brezina, Chicago, both of Ill.

[73] Assignee: Trinity Industries, Inc., Dallas, Tex.

[21] Appl. No.: 440,903

[22] Filed: Nov. 22, 1989

[51] Int. Cl.[5] ..... B60P 3/06

[52] U.S. Cl. ..... 410/67; 105/355

[58] Field of Search ..... 410/54, 77, 44, 52, 410/65, 67, 87, 90, 121, 127, 129, 155; 105/355

[56] References Cited

U.S. PATENT DOCUMENTS 2,678,139 5/1954 Gildersleeve ..... 410/90

4,754,709 7/1988 Gramse et al. .

*Primary Examiner*—Joseph F. Peters, Jr.
*Assistant Examiner*—Virna Lissi Mojica
*Attorney, Agent, or Firm*—Myers & Associates, Ltd.

[57] ABSTRACT

A Blocking shoe assembly for intervention between the sides of a railway car and containers mounted therein which has a stationary guide portion, the stationary portion being adapted to guide and hold wide containers from lateral shifting and the movable portion comprising a rotary member which is adapted to rollingly engage against a side of a narrower container and hold it in place when the movable portion is deployed.

20 Claims, 3 Drawing Sheets

RAILWAY FREIGHT CAR SHOE DESIGN

BACKGROUND OF THE INVENTION

This invention relates to railway cars and more specifically is direoted to a railroad car for carrying one or more cargo containers of different widths.

Railway box car have been in use for a long time. In order to prevent pilferage, theft, or damage to the goods and to insure the efficient and safe delivery of the goods, they are invariably packaged into theft proof containers which are loaded and transported on the cars for unloading at their destination.

The sizes of the containers have been more or less standardized within the dimensions of a railway car. One such car particularly adapted for carrying containers is designated a well car. Such a car has end and side walls and a partial or full floor defining a well or cavity into which one or more rectangular containers can be longitudinally positioned. The container sides are generaly at least two or three times higher than the well depth.

Furthermore, containers can be double stacked when desired to increase the shipping load.

Well cars suitable for carrying containers are also for highway trailers. Such car are shown in U.S. Pat. No. 4,091,742, 4,400,121, 4,456,413. Static guides for directing a container into and out of the car are shown in U.S. Pat. No. 4,754,709.

The standardized width of the containers placed in the well conventially have a width eight feet or eight feet six inches. Therefore the width of the well must be slightly larger or longer than six feet eight inches to receive the wider container.

It is difficult to center such containers in such wells. Even when initially entered accurately, the rocking of the car in transit can cause the container to shift to one side or the other of the car unbalancing it and causing the car to tilt which presents a dangerous condition which could cause a derailment. Also, the load in the container can be damaged as a result of the unbalance condition of the container.

A need exists to provide an effective dynamically operable means for blocking the container within the car which can receive and securely contain in centered position containers of two different widths of which one is considerably narrower than the other which fits into the car.

SUMMARY OF THE INVENTION

A principal object of the invention is to provide a novel shoe assembly which incorporates a roller which serves as a guide to facilitate insertion and withdrawal of the container with respect to a well car and which also serves as a stop to prevent lateral shifting of the container.

A further object is to provide a novel shoe assembly which is adapted to be mounted on the side of a car and which has upper and lower guides for guiding the container between the sides of a well car and which for the narrow cars is provided with rollers which engage the sides of the container and run therealong without gauging or scuffing the container.

The invention contemplates mounting a roller on one end of an arm which may be retracted or extended to provide a rolling surface against a container to facilitate deposit of the container into the car and withdrawal therefrom.

These and other objects of the invention will become more apparent from the specification and the drawings wherein:

FIG. 1 a generally schematic top plan view of a freight car incorporating the invention;

DESCRIPTION OF THE INVENTION

Figure 1:
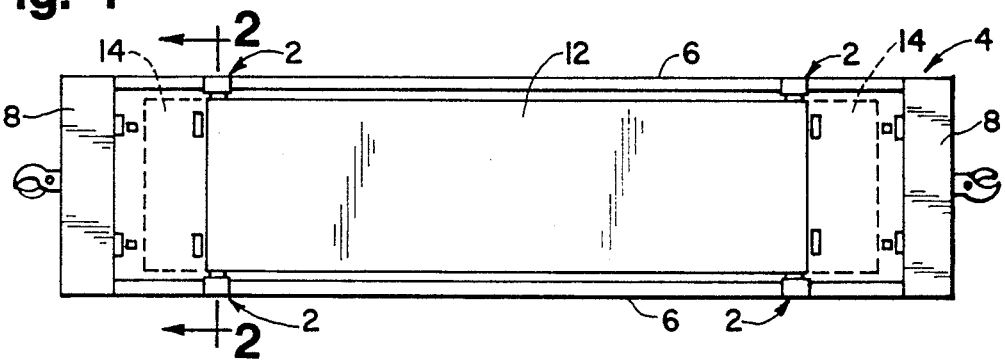

The shoe assemblies preferably made of steel, and generally designated 2, are associated with a railway well car 4 having side and end walls 6, 8 and a floor 10 defining a well for reception of two different width containers 12 and 14 which fit between the side walls 6 and 8.

Each shoe assembly comprises a vertically elongated bracket structure 15.

The bracket structure 15 has an outer vertical wall 16 which at its lower end 18 overlaps the upper portion 20 of an outer flange 21 of an inverted U-shaped side sill member 22 of the car and is welded thereto.

The lower end portions 24, 26 of the flange 21 and 28 are entered between the inboard and outboard side panels 30, 16 of an associated side wall 6 and are weld-connected thereto. A transverse horizontal web 34 of the side sill is welded to a horizontal reinforcing plate 35 which widthwise spans the space between the inner and outer walls 30, 16 of the bracket 15. The plate 35 may extend lengthwise the entire extent of the associated side sill or may be segmented and extend for a short distance on either side of bracket 15.

The bracket has a pair of upright reinforcing webs 44, 46 which span the space between :he inner and outer walls 30, 16 and are weld-connected thereto along contacting edges.

The upper guide portion 48 of the inner wall 36 of the bracket is angled at about 45 degrees and slopes downwardly and inwardly from the wall 16 and has an upper end portion 50 welded to the top side of the similarly angled upper end portion 38.

The wali 36 is formed as two coplanar legs 52, 54 defining a vertically elongated slot or aperture 55 therebetween and provide an upper slide surface 56 on wall portion 48 to guide a container into the well. The wall portion 48 terminates in an apical or nose configuration at 58 and the two legs of the lower portion of the inner web 36 extends downwardly and are interconnected at their lower ends by a transverse bar-like portion 62. A steel stop 64 (FIG. 4) is welded to the end of a pivotal shoe unit generally designated 65 and forms a stop therefor against portion 62.

The shoe unit or bumper assembly 65 has a pair of vertical side webs on arms 66, 67 spaced lengthwise of the car. They are interconnected by a face plate 70 which has a V-Shaped conformation including converging segments 72, 74 which terminate in an apex 75.

The face plate 70 is covered by a shim plate 71 welded thereto.

The side webs 66, 67 of the bearing arm are apertured at 76 and are pivoted at their inner ends via horizontally aligned apertures in the side webs 66, 67 of the bracket on a shaft 69.

A guide roller 80 is journaled on a shaft 82 which may be rotatably mounted in vertically elongated slots 84, in the pair of side members 66, 67. The extended position of the roller is determined by a shim 90 secured to the side members at the bottom of the slots 84. This determines the protrusion of the roller so as to engage in the extended position of the roller, the container. The gaging of the position of the rollers is accomplished after the shoe units are installed in the car, it being understood that the car dimensions are not precise when built. The space between opposing units is measured to accommodate in this space the narrow and wide containers.

As heretofore stated the position of the guide roller is retracted for a wide container and extended to a position to engage a side of a narrow container.

Figure 4:
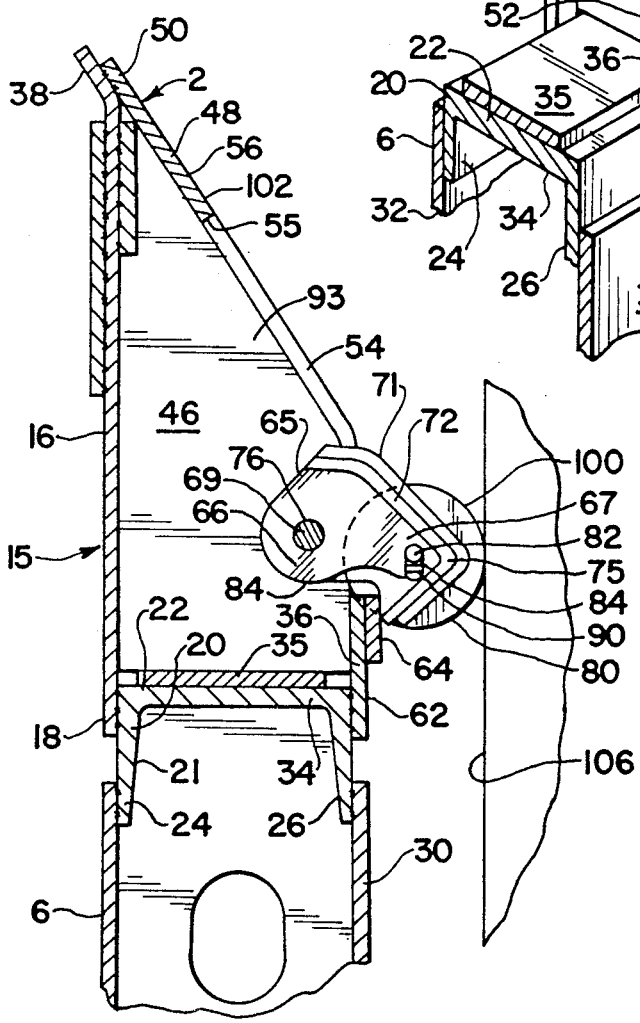
FIG. 4 is an enlarged sectional view taken on line 4—4 of FIG. 6.
Figure 5:
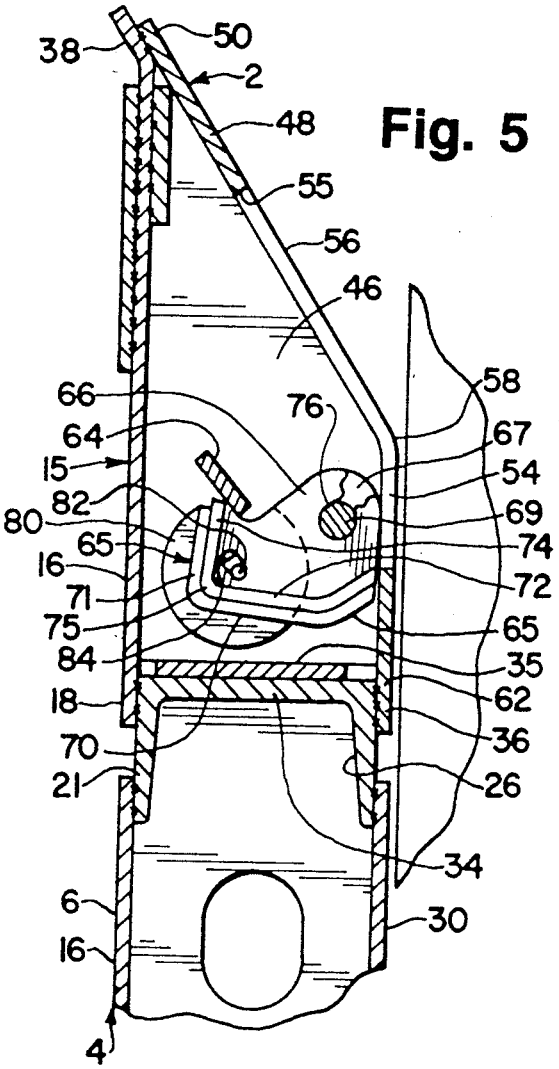
FIG. 5 is a view similar to FIG. 4 showing the parts in retracted position.
Figure 6:
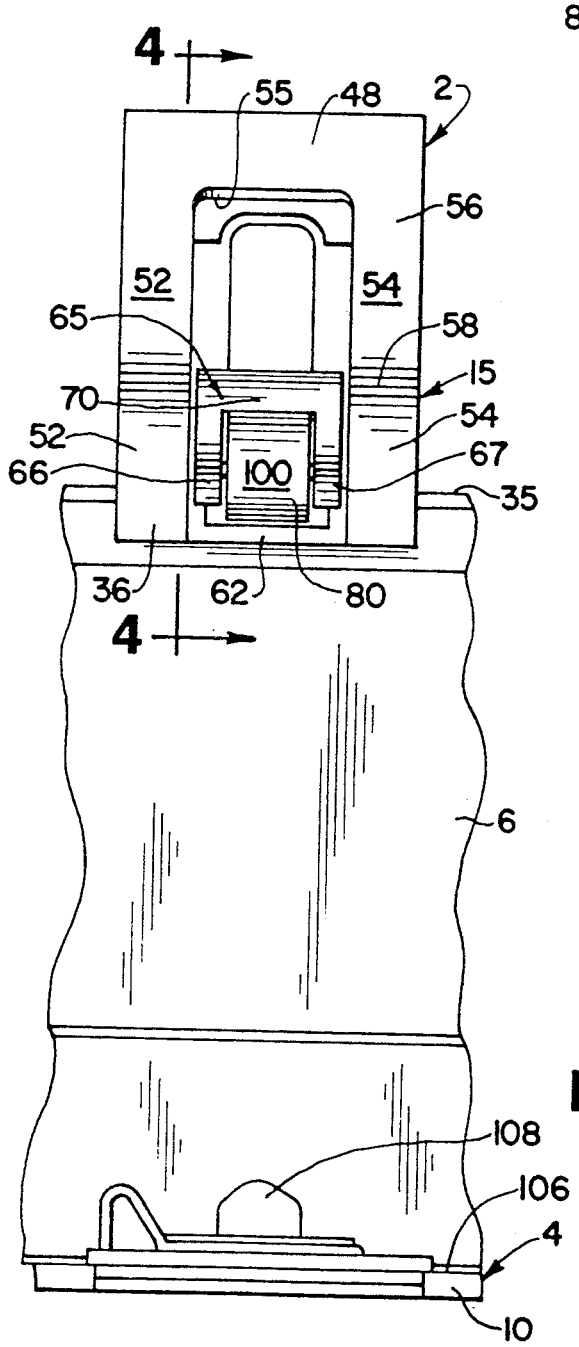
FIG. 6 is an internal side elevational view.

It will be understood that the wider containers will engage the upper stationary nose or apex 75 while the shoe unit 65 with the roller is retraoted into the space 93 beneath the wall portion 48, through the aperture 55 when not in use and extended when used wIth the narrower oontaIners as seen in FIG. 4.

When retracted the shoe assembly 2 has only its upper section exposed.

When a narrower container is being inserted into the well, the shoe assembly 65 is extended by flipping it to operative position as shown in FIGS. 2–4 and 6. In the extended operative position the periphery 100 of the roller is subtended by the plane of the upper guide surface 56 of the plate 48.

Thus when the narrow container is lowered one of its lower corners 105 may engage and slide inwardly along the guide face of the upper guide and then engage the periphery 100 of the roller which will be caused to rotate pursuant to the container being moved thereon and dropped further whereupon the roller will rotate in a direction rolling against the container side wall as the container decends into the well of the car.

Figure 2:
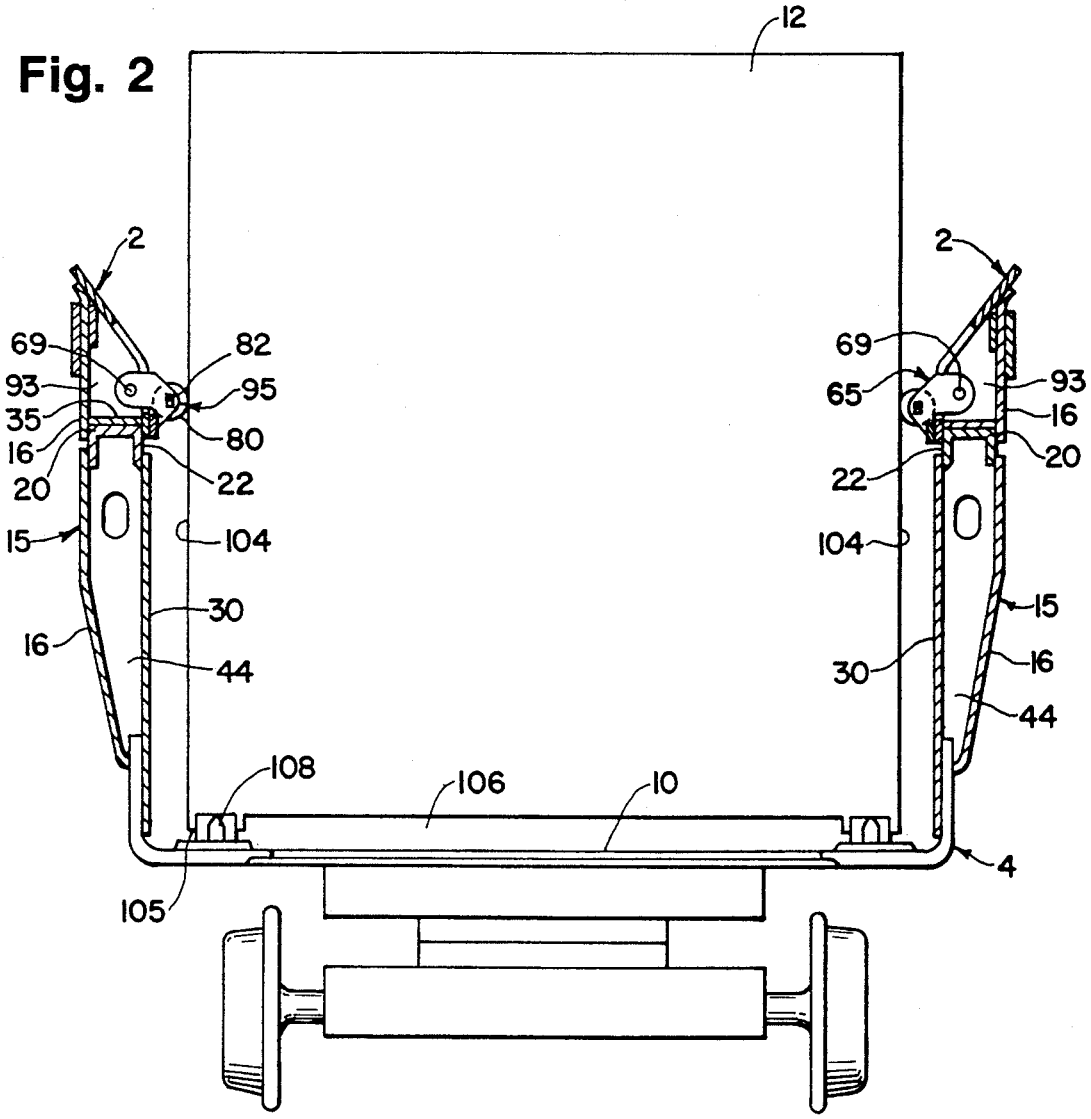
FIG. 2 is an enlarged vertical cross-section taken substantially on line 2—2 of FIG. 1.
Figure 3:
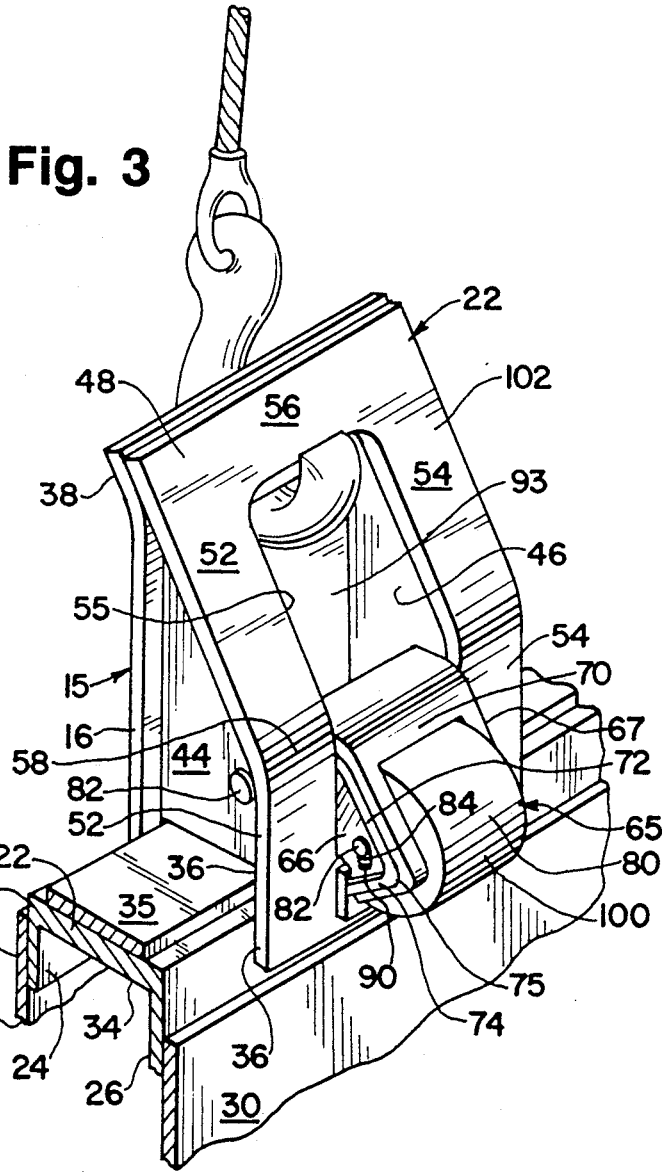
FIG. 3 is an enlarged perspective view of the new shoe assembly.

As the container is lowered the rollers opposite sides of the car as best seen in FIG. 2 will rotate along the respective sides 104, 104, of the container facilitating its entry or exit from the container without scuffing it.

Of particular importance is that the rollers will reduce damage from impact loads which caused the previously designed structure to bend when impacted during loading and unloading.

The invention further contemplates a rolling action of the rollers against the sides of a container during torsional twisting of the car.

The bottom of the well is provided with-cross bearers 106 which mount container supports 108.

What is claimed:

1. A railroad car for carrying a container comprising:

a car body supported by rail truck means adapted for movement over a railroad;

the car body having opposing side walls and an end wall near each end connected to the side walls, said side walls and ends walls defining a well in which a container can be received;

means for supporting the bottom of a container, when in the well;

guide means mounted along each side wall for effectively reducing the width of the well space so as to center in the well a container having a width significantly less than the well width to limit sideward movement of the container in the well when the car rocks;

the guide means comprising at least two spaced apart units along each side wall;

each unit having an element located on top of the side wall and movable on a horizontal axis from a stored position in which the width of the well is maximum to an operable guide position which reduces the well width to center the container;

the movable element having a forward nose portion which, when the element is in operable guide position, is adapted to be adjacent the wall of the container in the well;

the eIement having a downwardly sloped portion, having a surface extending to the nose portion, against which a container bottom side corner can slide to guide a container being lowered into the well;

the unit including a stationary base joined to the top of the side wall, the movable element being mounted to the base to rotate about said horizontal axis, the base having a sloped surface for guiding into the well a container having a width approximately the same as but smaller than the well width; and said movable element comprising a roller, a rotatable about a horizontal axis subtending the plane of the sloped surface when said movable element is in operative position.

2. A railroad car for carrying a container comprising:

a car body supported by rail truok means adapted for movement over a railroad;

the car body having opposing side walls and an end wall near each end connected to the side walls, said side walls and end walls defining a well in which a container can be received;

guide means mounted along each side wall for effectively reducing the width of the well space so as to center in the well a container having a width significantly less than the well width and limit sideward movement of the container in the well when the car rocks;

the guide means comprising at least two spaced apart guide units along each side wall;

each guide unit having a movable assembly mounted said guide unit on a horizontal axis for movement between a stored position in which the width of the well is maximum for storing wide-width container and an operable guide position which reduces the well width to center and hold a narrow-width container;

said movable assembly having a roller, rotatable about a horizontal axis for rolling guided engagement with a side of a narrow container.

3. A railroad car for carrying narrow and wide-width containers comprising:

a car body having opposing side walls and end walls defining a well inwhich a container can be received;

means for supporting the bottom of a container when in the well;

a bumper assembly comprising guide means mounted along each side wall for effectively reducing the width ofthe well space so as to center in the well a container having a matching narrow width to limit sideward movement of the container in the well when the car rocks;

the bumper assembly including a stationary member joined to the top of the side wall and having a sloped surface for guiding a container;

said assembly including a movable element located osn the top of the side wall and movable about an axis from a stored position in which the width of the well is maximum to accept a wide-width container and to an operable intruding guide position into the well for reducing the well width to center a narrow-width container;

the movable element having a nose portion which, when the element is operable guide position, is adapted to be positioned adjacent the well of a narrow-width container inthe well; and a roller carried, a rotatable about a horizontal axis on said nose portion, upon which a container bottom side is adapted to ride to guide a container being lowered into the well or lifted therefrom; and the sloped surface lying in a plane itnersectisng the peripheral surface of the roller when the movable element is in operable guide position.

4. For use in a railway car havingupright side and end walls defining a well encasing containers supported therein, combined guide and retainer means mounted on a side wall, and comprising an upper guide surface sloping inwardly toward the well, and a roller extending through the plane of said surface and positioned inwardly of the ajdacent side wall for engagement with a container as it is guided onsaid upper guide surface into said well, said roller, mounted on a horizontal axis beingoperative to lift said container off said surface and rotatably guide it into said well, said retainer means mounting said roller for rotation on an axis substantially parallel with said surface, and shim means on said retainer means for incrementally adjusting the position of said roller.

5. For use in a railway car having upright side and end walls defining a well encasing containers supported therein, combined guide and retainer means moaunted on a side wall and comprising an upper guide surface sloping inwardly toward the well, and a roller, a rotatable about a horizontal axis extendign through the plane of said surface and positioned inwardly of the adjacent side wall for engagement with a container as it is guided on said upper guide surface into said well, said roller being operative to lift said contaienr off said surface and rotatably guide it into sid well.

6. The invention according to claim 3, and said roller protruding beyond the nose position for engagement by the container.

7. the invention according to claim 3, and said smovable element being foldable into the bracket so as not to itnerfere with the placement of a wide-width container.

8. the invention according to claim 5, and said roller having a container-engaging peripheral surface subtending in operative position said upper guide surface.

9. The invention according to claim 5, and means for retracting said roller to a position beneath said upper guide surface.

10. The invention according toc laim 9, and said means for retracting said roller being operative to extend said roller into a position intersecting its peripheral surface with said upper surface.

11. the invention according to claim 9, and said means for retracting said roller being pivotal on an axis parallel with said upper surface.

12. The invention according to claim 5, and said retainer means mounting said roller for rotation on an axis substantially parallel with said surface.

13. the invention according to claim 9, and said means for retracting the roller swingable with the roller about an axis to a position past dead center preventing the roller from inadvertently moving ot an extended position.

14. The invention according toc laim 9, and said means for retracting said roller bieng movable to an extended operative position disposing the roller at the lower end of said upper surface, and means for limiting movement of said roller beyond its operative position.

15. The invention according toc laim 14, and stop means for limiting the retracting means to predetermined retracted and extended positions.

16. The invention according to claim 12, and a bracket attached to a side wall and said upper surface thereon extending above a related side wall, arms pivoted to the bracket and supporting said roller, and means for limiting pivotal movement of the arms and roller to positions beneath said upper surface and to an extend position extending through said surface.

17. the invention according to claim 5, and a slot interrupting said upper surface, and said roller in extended position projecting through said slot.

18. the invention according to claim 5, and said guide and retainer means comprising a vertical leg with said upper surface thereon said vertical leg extending downwardly from said upper surface and attachable from said upper surface and attachable to an associated side wall.

19. the invention according toc laim 18, and means mounting siad roller on the bracket for pivotal movement between retracted and extended position.

20. the invention according to claim 19, and said mounting means providing a horizontal axis for pivot and a horizontal axis of rotation for the roller.

* * * * *